US007862147B2

(12) United States Patent
Ciminelli et al.

(10) Patent No.: US 7,862,147 B2
(45) Date of Patent: Jan. 4, 2011

(54) INCLINED FEATURE TO PROTECT PRINTHEAD FACE

(75) Inventors: Mario Joseph Ciminelli, Rochester, NY (US); Douglas Harold Pearson, Rochester, NY (US); James Edward Vianco, Sr., Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 281 days.

(21) Appl. No.: 12/241,816

(22) Filed: Sep. 30, 2008

(65) Prior Publication Data

US 2010/0079542 A1 Apr. 1, 2010

(51) Int. Cl.
*B41J 2/15* (2006.01)
*B41J 2/145* (2006.01)

(52) U.S. Cl. ..... 347/40; 347/49

(58) Field of Classification Search ..... 347/20, 347/40–43, 47, 49, 54, 56, 61, 66–71
See application file for complete search history.

(56) References Cited

U.S. PATENT DOCUMENTS 6,206,499 B1 3/2001 Iijima et al. ..... 347/33
7,350,902 B2 4/2008 Dietl et al. ..... 347/43
2008/0030543 A1 * 2/2008 Heo et al. ..... 347/40
2008/0149024 A1 6/2008 Petruchik et al. ..... 118/300

* cited by examiner

*Primary Examiner*—Thinh H Nguyen
(74) *Attorney, Agent, or Firm*—Stephen H. Shaw

(57) ABSTRACT

A printhead has a substrate with a mounting surface for a printhead die. The printhead die includes a first face bonded to the mounting surface of the substrate and a second face opposite the first face. The second face including at least one array of marking elements disposed along a marking element array direction. An edge of the printhead die is substantially parallel to the marking element array direction. An inclined surface is positioned proximate to, but not overlapping the edge of the printhead die, wherein a distance from the inclined surface to the mounting surface of the substrate at a first location is greater than a distance from the inclined surface to the mounting surface of the substrate at a second location, the first location also being nearer the edge of the printhead die that is substantially parallel to the marking element array direction than the second location.

14 Claims, 9 Drawing Sheets

INCLINED FEATURE TO PROTECT PRINTHEAD FACE

FIELD OF THE INVENTION

The present invention relates generally to the portion of a printhead that confronts recording media, and more particularly to a feature designed to protect the face of the printhead against damage if the recording medium strikes the printhead.

BACKGROUND OF THE INVENTION

Many types of printing systems include one or more printheads that have arrays of marking elements that are controlled to make marks of particular sizes, colors, etc. in particular locations on the recording media in order to print the desired image. In some types of printing systems the array of marking elements extends across the width, and the image can be printed one line at a time. However, the cost of a printhead that includes a page-width array of marking elements is too high for some types of printing applications, so a carriage printing architecture is used.

In a carriage printing system (whether for desktop printers, large area plotters, etc.) the printhead or printheads are mounted on a carriage that is moved past the recording medium in a carriage scan direction as the marking elements are actuated to make a swath of dots. At the end of the swath, the carriage is stopped, printing is temporarily halted and the recording medium is advanced. Then another swath is printed, so that the image is formed swath by swath. In a carriage printer, the marking element arrays are typically disposed along an array direction that is substantially parallel to the media advance direction, and substantially perpendicular to the carriage scan direction.

In some types of printers, such as inkjet printers, the face of the printhead die is positioned near the recording medium in order to provide improved print quality. Close positioning of the printhead face to the recording medium keeps the printed dots close to their intended locations, even for angularly misdirected jets.

In order to provide the capability of printing across the entire width of the recording medium, and also to allow space for the carriage to decelerate and stop before changing directions to print the next swath, typically the carriage moves the printhead beyond the side edges of the recording medium. Generally, the position of the recording medium relative to the printhead face is fairly well controlled. However, occasionally a sheet of recording medium can have a dog-eared edge. Also occasionally multiple sheets of recording medium can be inadvertently fed at the same time, sometimes relating in paper jamming and folding in accordion fashion. In such situations, the close proximity of the printhead face to the nominal position of the recording medium can result in recording medium striking the face of the printhead as the carriage moves the printhead past the edge of the recording medium. For printhead faces made of material that is fragile or brittle, such strikes can cause catastrophic damage to the printhead, requiring its replacement.

U.S. Pat. No. 6,206,499 describes a head cover that overlaps the sides of the edges of the printhead die in order to prevent the nozzle plate being damaged due to "paper stacking". However, there is no mention of the effectiveness of the head cover against damage of the printhead face due to folded or dog-eared edges of recording medium. In addition, the head cover described in '499 is an additional discrete part which must be separately made and assembled into the printhead.

A cost-effective mounting assembly for printhead die is thus required that will provide protection of the face of the printhead die against strike damage due to a wide range of recording medium feeding problems for printers where the printhead face is positioned close to the recording medium.

SUMMARY OF THE INVENTION

The above need is met by providing a printhead having a substrate with a mounting surface for an innovative printhead die. The printhead die includes a first face bonded to the mounting surface of the substrate and a second face opposite the first face. The second face including at least one array of marking elements disposed along a marking element array direction. At least one edge of the printhead die is substantially parallel to the marking element array direction. An inclined surface is positioned proximate to, but not overlapping the edge of the printhead die, wherein a distance from the inclined surface to the mounting surface of the substrate at a first location is greater than a distance from the inclined surface to the mounting surface of the substrate at a second location, the first location also being nearer the at least one edge of the printhead die that is substantially parallel to the marking element array direction than the second location.

Another aspect of the invention provides a method for forming a mounting assembly for a printhead die; including:

a) providing a mounting substrate, wherein the mounting substrate includes at least one groove for receiving molding material;

b) inserting the mounting substrate into a mold tool having features to form an inclined surface;

c) introducing molding material into the mold tool to flow along the groove and into the features such that the inclined surface is formed by the mold tool and is anchored to the mounting substrate; and d) removing the mounting assembly from the mold tool for subsequently mounting a printhead die.

A third aspect of the invention provides an inkjet printing apparatus that includes a carriage that travels in a carriage scanning direction. A printhead is positioned on the carriage and includes a substrate having a mounting surface; and a printhead die. The printhead die has a first face that is bonded to the mounting surface of the substrate; and a second face opposite the first face. The second face includes at least one array of marking elements disposed along a marking element array direction. An edge of the printhead die is substantially parallel to the marking element array direction. Finally, an inclined surface is positioned proximate to, but not overlapping the edge of the printhead die, wherein a distance from the inclined surface to the mounting surface of the substrate at a first location is greater than a distance from the inclined surface to the mounting surface of the substrate at a second location, the first location also being nearer the edge of the printhead die that is substantially parallel to the marking element array direction than the second location.

DETAILED DESCRIPTION OF THE INVENTION

Figure 1:
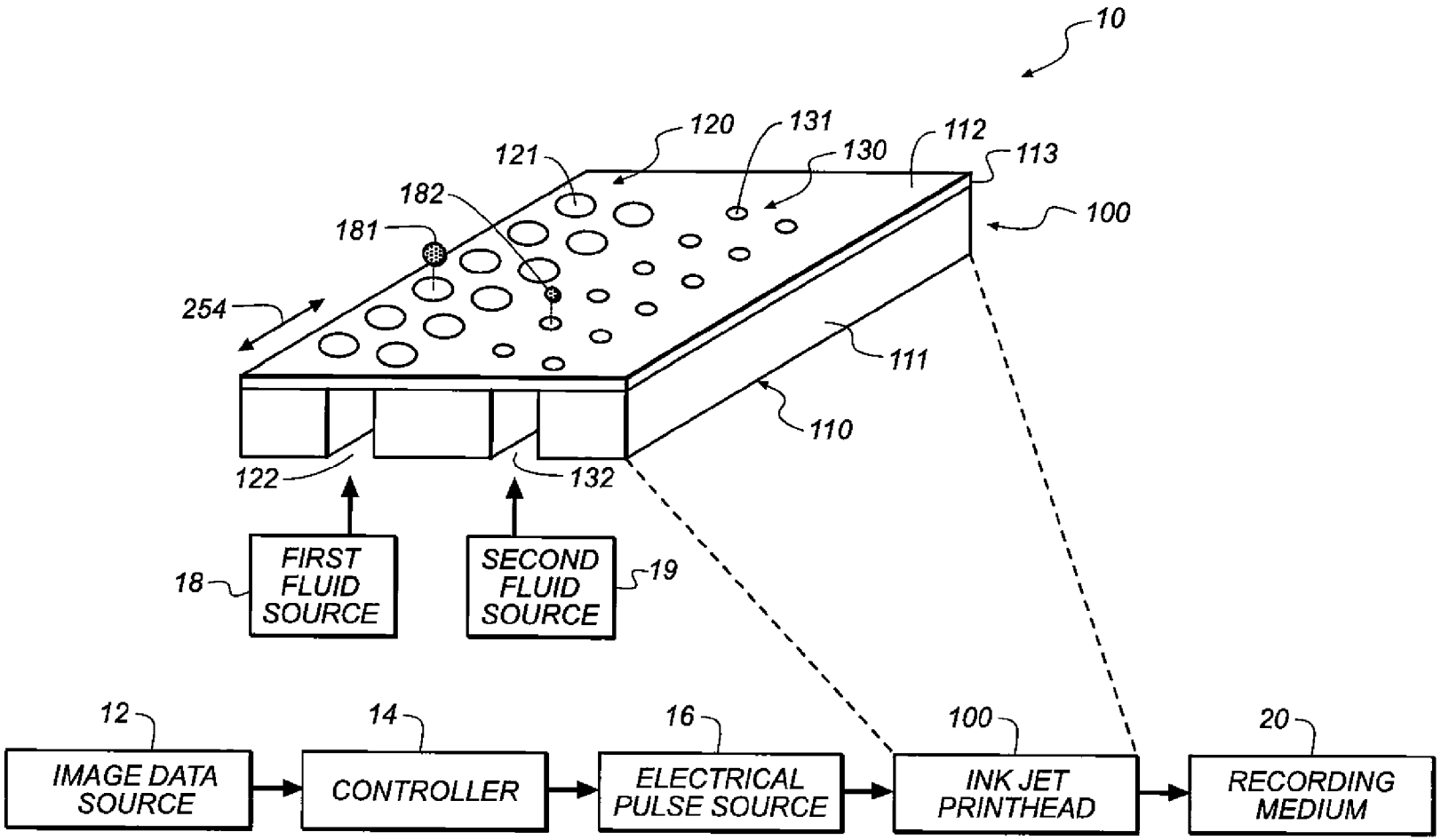
FIG. 1 schematically shows an inkjet printer system.

Referring to FIG. 1, a schematic representation of an inkjet printer system 10 is shown, as described in U.S. Pat. No. 7,350,902. The system includes a source 12 of image data, which provides signals that are interpreted by a controller 14 as being commands to eject drops. Controller 14 outputs signals to a source 16 of electrical energy pulses that are inputted to the inkjet printhead 100 which includes at least one printhead die 110. In the example shown in FIG. 1, there are two nozzle arrays provided on a nozzle face (or nozzle plate) 112, formed on substrate 111 of printhead die 110. Nozzles 121, in the first nozzle array 120 have a larger opening area than nozzles 131 in the second nozzle array 130. Nozzle arrays 120 and 130 extend along array direction 254. In this example, each of the two nozzle arrays has two staggered rows of nozzles, each row having a nozzle density of 600 per inch. The effective nozzle density then in each array is 1200 per inch. If pixels on the recording medium were sequentially numbered along the paper advance direction, the nozzles from one row of an array would print the odd numbered pixels, while the nozzles from the other row of the array would print the even numbered pixels.

Nozzle plate 112 includes an edge at or near die edge 113 where nozzle plate 112 adjoins die substrate 111 on the edge of printhead die 110 that is substantially parallel to array direction 254. As described below, edge 113 moves past opposite side edges of the recording medium 20 during printing.

In fluid communication with each nozzle array is a corresponding ink delivery pathway. Ink delivery pathway 122 is in fluid communication with nozzle array 120, and ink delivery pathway 132 is in fluid communication with nozzle array 130. Portions of fluid delivery pathways 122 and 132 are shown in FIG. 1 as openings through printhead die substrate 111.

One or more printhead die 110 will be included in inkjet printhead 100, but only one printhead die 110 is shown in FIG. 1. The printhead die are arranged on a mounting support as discussed below relative to FIG. 2. In FIG. 1, first ink source 18 supplies ink to first nozzle array 120 via ink delivery pathway 122; and second ink source 19 supplies ink to second nozzle array 130 via ink delivery pathway 132. Although distinct ink sources 18 and 19 are shown, in some applications it may be beneficial to have a single ink source supplying ink to nozzle arrays 120 and 130 via ink delivery pathways 122 and 132 respectively. Also, in some embodiments, fewer than two or more than two nozzle arrays may be included on printhead die 110. In some embodiments, all nozzles on a printhead die 110 may be the same size, rather than having multiple sized nozzles on a printhead die.

Not shown in FIG. 1, are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bilayer element) and thereby cause ejection. In any case, electrical pulses from pulse source 16 are sent to the various drop ejectors according to the desired deposition pattern. In the example of FIG. 1, droplets 181 ejected from nozzle array 120 are larger than droplets 182 ejected from nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
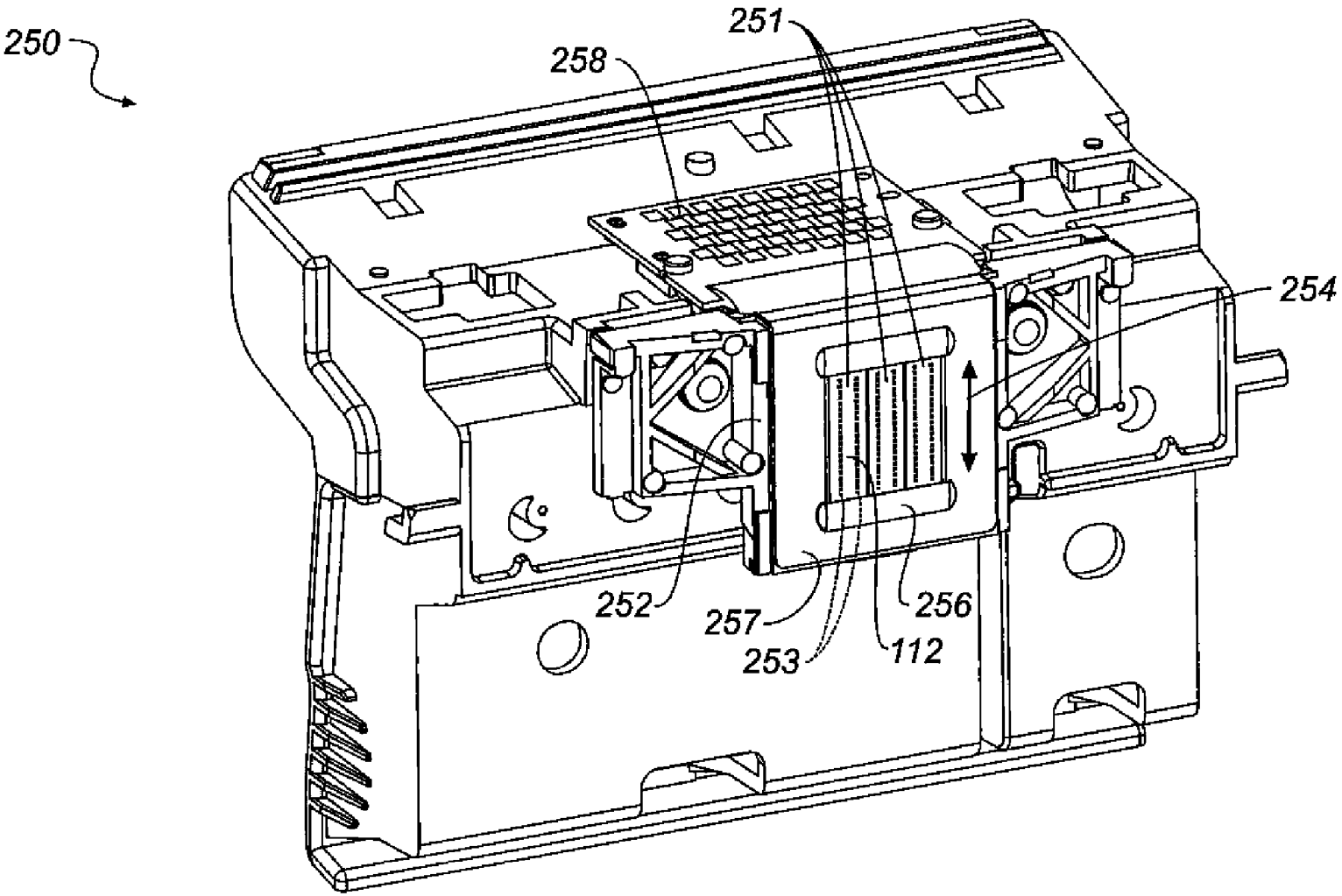
FIG. 2 shows a perspective view of a portion of a printhead chassis.

FIG. 2 shows a perspective view of a portion of a printhead chassis 250, which is an example of an inkjet printhead 100. Printhead chassis 250 includes three printhead die 251 (similar to printhead die 110), each printhead die containing two nozzle arrays 253 formed on a nozzle face 112, so that printhead chassis 250 contains six nozzle arrays 253 altogether. The six nozzle arrays 253 in this example may be each connected to separate ink sources (not shown in FIG. 2), such as cyan, magenta, yellow, text black, photo black, and a colorless protective printing fluid.

The three printhead die 251 are mounted on mounting substrate 252 such that each of the six nozzle arrays 253 is disposed along array direction 254. The length of each nozzle array along direction 254 is typically on the order of 1 inch or less. Typical lengths of recording media are 6 inches for photographic prints (4 inches by 6 inches), or 11 inches for 8.5 by 11 inch paper. Thus, in order to print the full image, a number of swaths are successively printed while moving printhead chassis 250 across the recording medium. Following the printing of a swath, the recording medium is advanced.

Also shown in FIG. 2 is a flex circuit 257 to which the printhead die 251 are electrically interconnected, for example by wire bonding or TAB bonding. The interconnections are covered by an encapsulant 256 to protect them. Flex circuit 257 bends around the side of printhead chassis 250 and connects to connector board 258. When printhead chassis 250 is mounted into the carriage 200 (see FIG. 3), connector board 258 is electrically connected to a connector (not shown) on the carriage 200, so that electrical signals may be transmitted to the printhead die 251.

Figure 3:
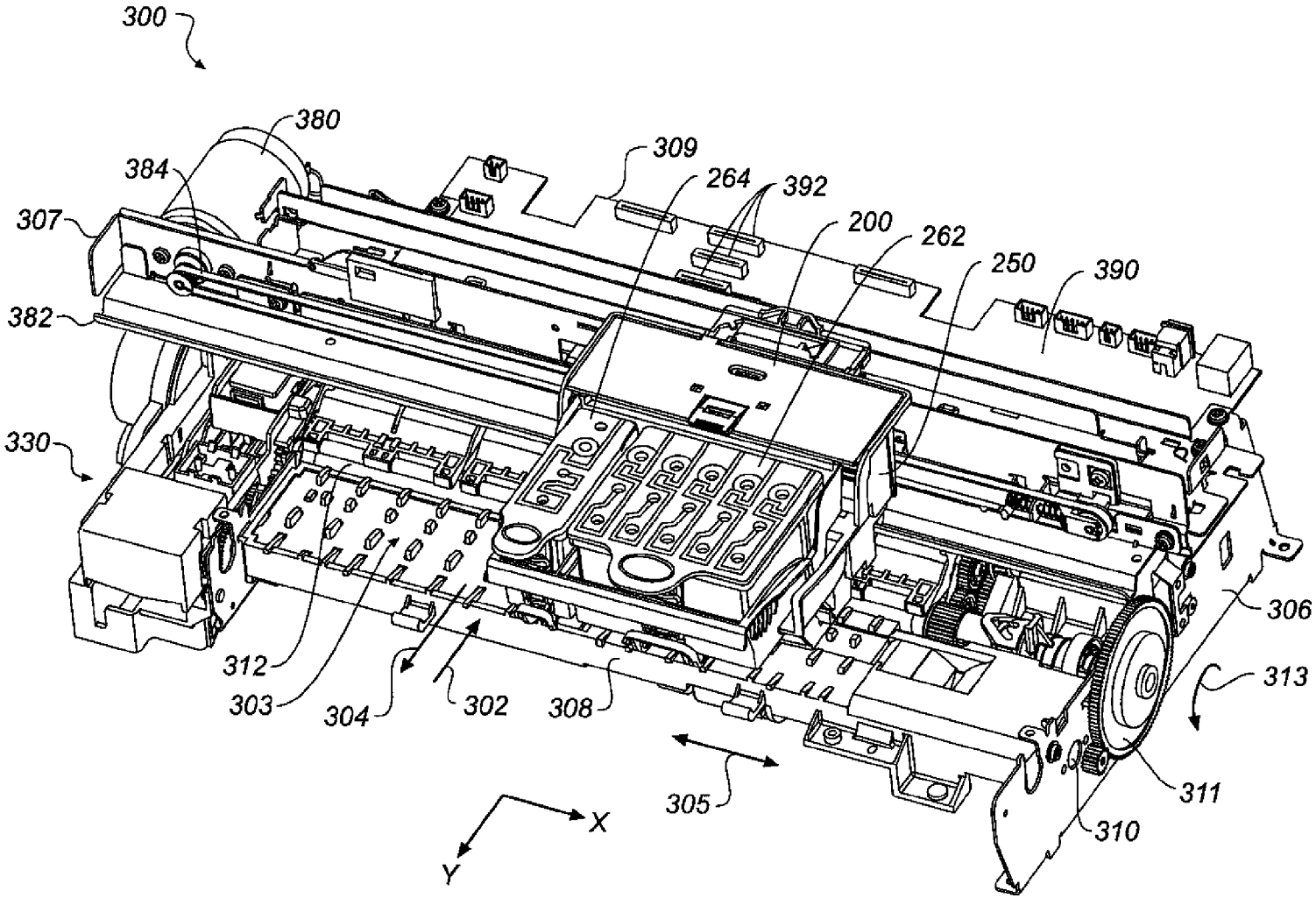
FIG. 3 is a perspective view of a portion of a carriage printer.

FIG. 3 shows a portion of a carriage printer. Some of the parts of the printer have been hidden in the view shown in FIG. 3 so that other parts may be more clearly seen. Printer chassis 300 has a print region 303 across which carriage 200 is moved back and forth in carriage scan direction 305 along the X axis between the right side 306 and the left side 307 of printer chassis 300 while printing. Carriage motor 380 moves belt 384 to move carriage 200 back and forth along carriage guide rail 382. Printhead chassis 250 is mounted in carriage 200, and ink supplies 262 and 264 are mounted in the printhead chassis 250. The mounting orientation of printhead chassis 250 is rotated relative to the view in FIG. 2, so that the printhead die 251 are located at the bottom side of printhead chassis 250, the droplets of ink being ejected downward onto the recording media in print region 303 in the view of FIG. 3. Ink supply 262, in this example, contains five ink sources—cyan, magenta, yellow, photo black, and colorless protective fluid, while ink supply 264 contains the ink source for text black.

Paper or other recording media (sometimes generically referred to as paper herein) is loaded along paper load entry direction 302 toward the front 308 of printer chassis 300. A variety of rollers are used to advance the medium through the printer, as shown schematically in the side view of FIG. 4. In this example, a pickup roller 320 moves the top sheet 371 of a stack 370 of paper or other recording media in the direction of arrow 302. A turn roller 322 acts to move the paper around a C-shaped path (in cooperation with a curved rear wall surface) so that the paper continues to advance along direction arrow 304 from the rear 309 of the printer. The paper is then moved by feed roller 312 and idler roller(s) 323 to advance across print region 303, and from there, to a discharge roller 324 and star wheel(s) 325 so that printed paper exits along direction 304. Referring again to FIG. 3, feed roller 312 includes a feed roller shaft along its axis, and feed roller gear 311 is mounted on the feed roller shaft. Feed roller 312 may consist of a separate roller mounted on feed roller shaft, or may consist of a thin high-friction coating on feed roller shaft. The motor that powers the paper advance rollers is not shown in FIG. 3, but the hole 310 at the right side 306 of the printer chassis 300 is where the motor gear (not shown) protrudes through in order to engage feed roller gear 311, as well as the gear for the discharge roller (not shown). For normal paper pick-up and feeding, it is desired that all rollers rotate in forward direction 313. Toward the left side 307 in the example embodiment of FIG. 3 is the maintenance station 330. Toward the rear 309 of the printer in this example is located the electronics board 390, which contains cable connectors 392 for communicating via cables (not shown) to the printhead carriage 200 and from there to the printhead. Also on the electronics board are typically mounted motor controllers for the carriage motor 380 and for the paper advance motor, a processor and/or other control electronics for controlling the printing process, and an optional connector for a cable to a host computer.

Figure 4:
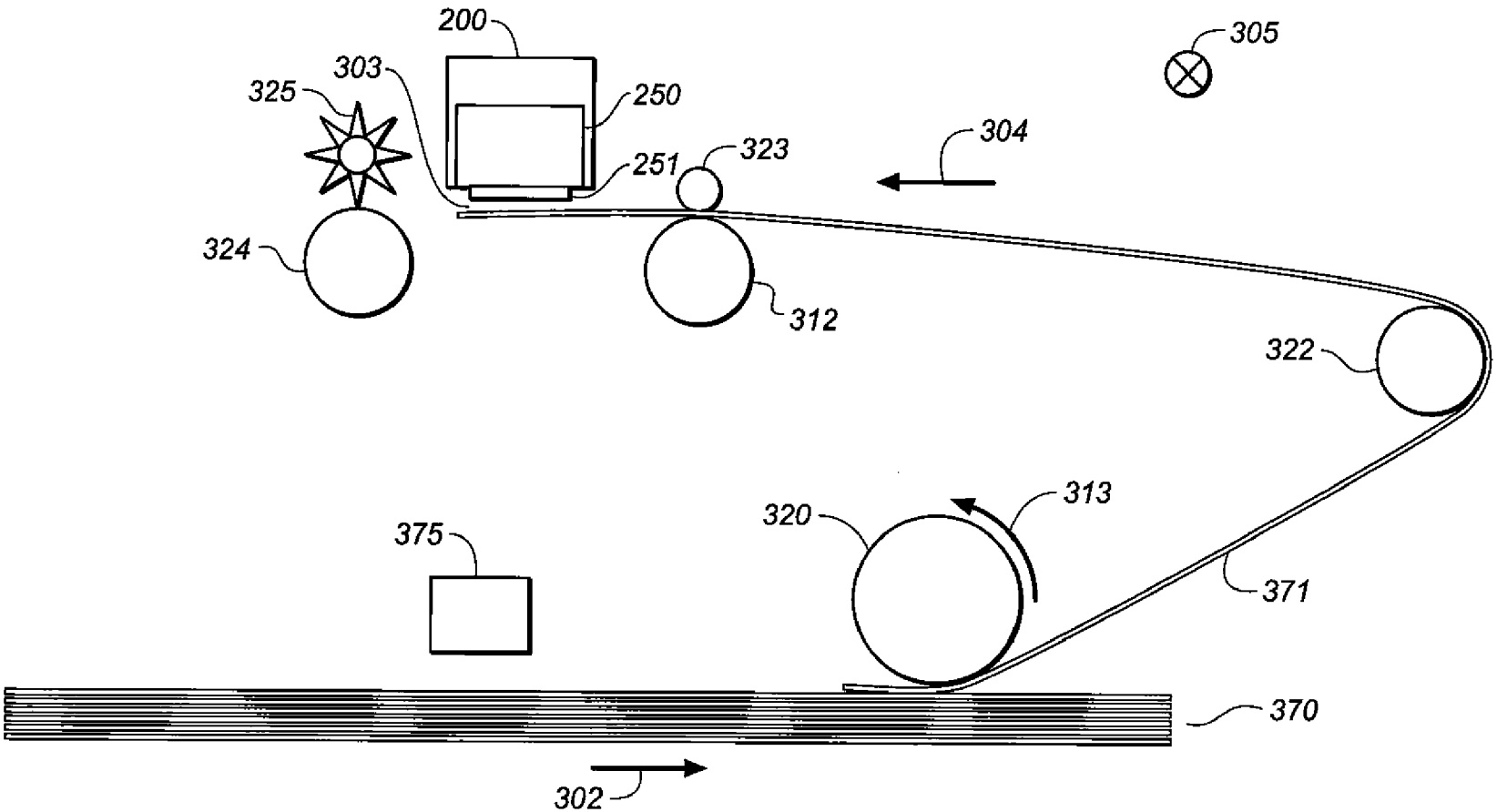
FIG. 4 is a schematic side view of a paper path in a carriage printer.

Referring to FIG. 4, carriage 200 is moved back and forth along carriage scan direction 305 (into and out of the plane of FIG. 4). In order to allow the nozzles to print the entire region of the paper, and then slow down the carriage to a stop prior to printing the next swath, the printhead die 251 typically travels beyond the side edges of sheet 371 of paper.

In order to provide good print quality, the printhead chassis 250 is positioned such that nozzle face 112 of printhead die 251 is somewhat close to sheet 371 of paper in printing region 303. Due to manufacturing defects or other asymmetries, for example, some jets may be angularly misdirected By positioning nozzle face 112 of printhead die 251 nominally within about 1.5 mm of sheet 371 in printing zone 303, it is found that misdirected jets do not deviate too far from their intended positions so that the corresponding printed dots land in approximately the correct positions on sheet 371.

Because the nozzle face 112 of printhead die 251 (as seen in FIG. 2), is somewhat close to the sheet 371 of paper or other recording medium, in some undesirable circumstances, the sheet 371 can actually strike the nozzle face 112 or die edge 113 (shown in FIG. 1). This can occur, for example, if the paper becomes folded or dog-eared, as schematically shown by folded edge 372 in FIG. 5. Paper strikes can also occur if multiple sheets are inadvertently fed at the same time, especially if a resulting paper jam causes the paper to fold in accordion fashion. In some instances, paper strikes result in ink smears on the printed page. However, an even more serious result can occur, if the paper strike damages the nozzle face 112. Some types of nozzle faces are formed of fragile or brittle materials that can break or become distorted due to a paper strike such that future print quality is unacceptable and the printhead needs to be replaced.

Embodiments of the present invention include one or more inclined surfaces that are positioned near the edge of the printhead die, such that if a dog-eared edge or other portion of paper is about to strike the nozzle face 112 or die edge 113, it first hits the inclined surface and is deflected away from the nozzle face and die edge, thereby protecting the nozzle plate from damage. Because a carriage printer typically moves the printhead back and forth past both side edges of the paper, embodiments will be described in which an inclined surface or ramp is provided on opposite sides of the printhead die.

Figure 5:
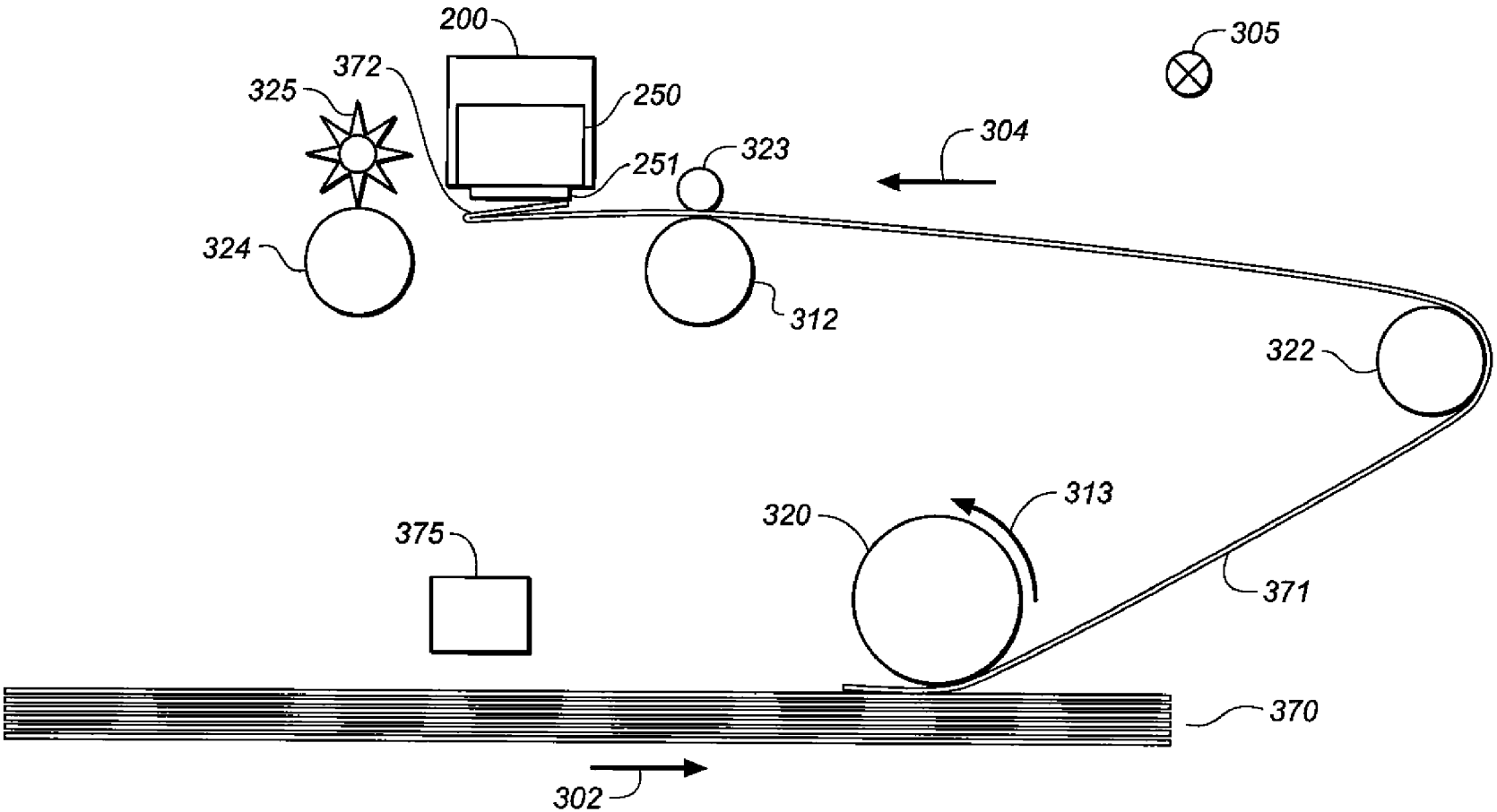
FIG. 5 is similar to FIG. 4, but for the case of a folded or dog-eared edge of paper striking the printhead face.
Figure 6:
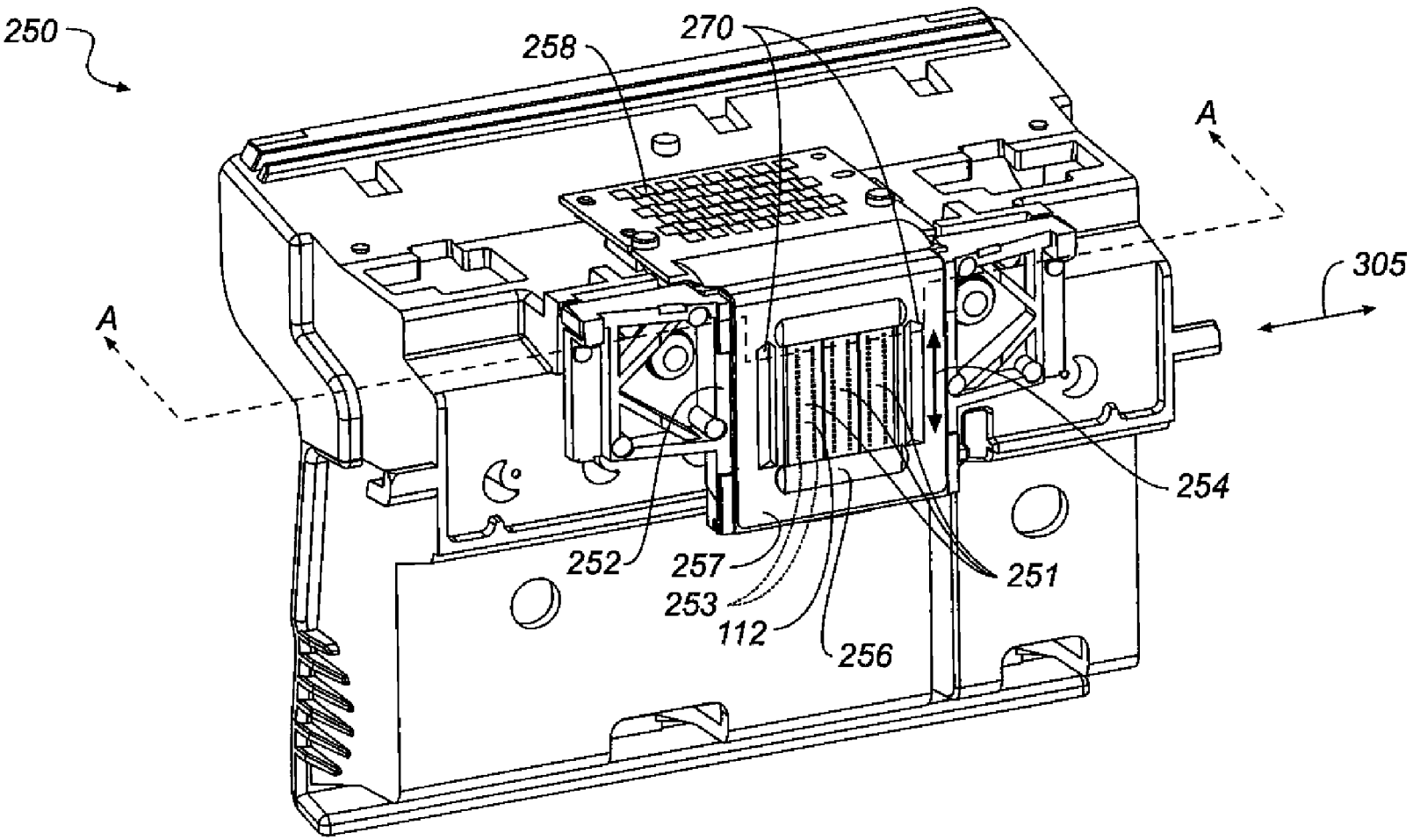
FIG. 6 is a perspective view of a portion of a printhead chassis according to an embodiment of the present invention

FIG. 6 schematically shows a pair of inclined surfaces 270 provided on opposite sides of the three printhead die 251. FIG. 6 shows a printhead configuration substantially the same as shown in FIG. 3, except for the addition of the inventive inclined surfaces 270. As the printhead chassis 250 is moved by carriage 200 along carriage scan direction 305, printhead die 251 are repeatedly moved past the side edges of sheet 371 of recording medium between printing of swaths. Sheet 371 of recording medium can include a dog-eared edge 372, for example, as shown in FIG. 5. When sheet 371 is advanced such that dog-eared edge 372 is aligned with printing zone 303, moving the carriage 200 in carriage scan direction 305 can cause dog-eared edge 372 to strike the printhead in the region of the printhead die 251.

If, as in FIG. 3, there are no inclined surfaces protecting printhead die 251, the dog-eared edge 372 of recording medium can strike the face of nozzle plate 112 or at its edge 113 (shown in FIG. 1) where the nozzle plate 112 adjoins the die substrate 111. If nozzle plate 112 is made of a fragile or brittle material, or if the bond between nozzle plate 112 and die substrate 111 is sufficiently weak, paper strikes in either location can cause catastrophic damage to die 251.

The inventive inclined surfaces 270 deflects dog-eared edges 372 or other portions of paper being too closely approached, so that the paper skates along the inclined surface 270 and clears the printhead die edge 113 and nozzle face 112. It has been found that, for property designed inclined surfaces 270, even if the deflected paper subsequently rebounds in time to hit a nozzle face 112 as the carriage 200 moves past, the paper makes a soft bounce landing rather than a damaging hard impact. Because dog-eared edges 372 or other types of paper folds can occur at either opposite side of sheet 371 of recording medium, inclined surfaces 270 are provided on both opposite sides of the printhead die 251 in this example.

As shown in FIG. 6, the inclined surface 270 is positioned near an edge 113 of the printhead die 251 such that this edge is substantially parallel to nozzle array direction 254. That is because this is the edge of the die 251 (at or near the edge of nozzle plate 112) that approaches the edge of the sheet 371 of recording medium as the carriage 200 is scanned in carriage scan direction 305. As will be made clearer below, the "tallest" portion of inclined surface 270 is nearest this edge 113 of die 251 that is substantially parallel to nozzle array direction 254 and includes the nozzle plate edge. The inclined surface 270 decreases in height relative to the surface of mounting substrate 252 at positions farther away from this edge of die 251.

Figure 7A:
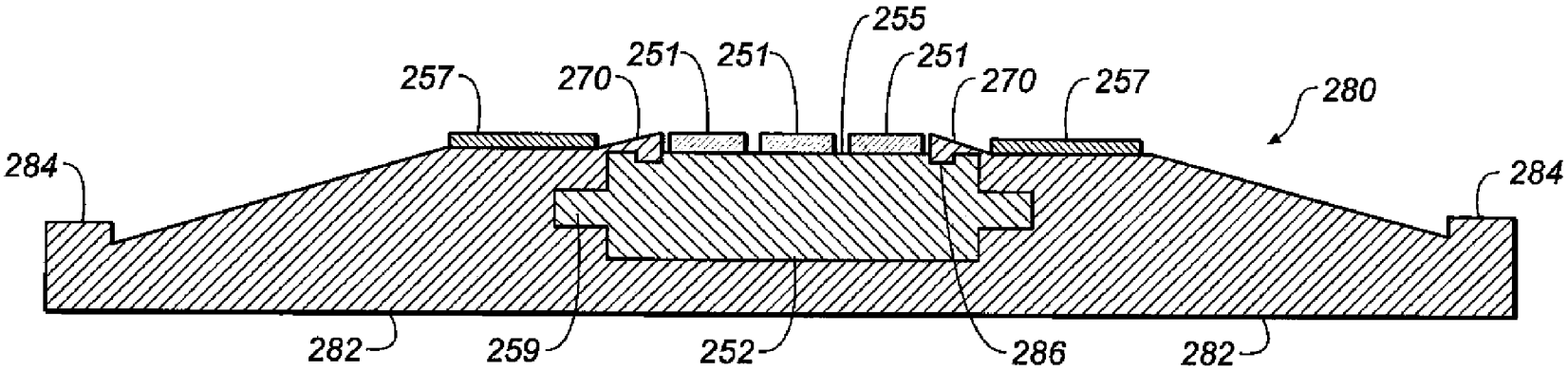
FIGS. 7A and 7B are schematic cross-sectional views of portions of a mounting assembly according to an embodiment of the present invention.

FIG. 7A schematically shows a cross-section (A-A in FIG. 6) of one embodiment of the invention. Mounting assembly 280 is a part of printhead chassis 250 that can be made by insert molding, for example, as described in U.S. Patent Publication No. 2008/0149024 A1, and includes a mounting substrate 252 for printhead die 251. Mounting assembly 280 also includes an extended portion 282 that provides alignment features 284, as well as a support for flex circuit 257. In the insert molding process, die mounting substrate 252 (formed of ceramic, for example) can be placed in an injection molding tool and extended portion 282 is then formed (for example by molded plastic) around die mounting substrate 252. Die mounting substrate 252 includes a mounting surface 255 to which printhead die 251 are later attached during printhead assembly. Optionally, die mounting substrate 252 includes an outer rim 259 that helps secure the die mounting substrate 252 to the molded plastic of mounting assembly 280. Die mounting substrate 252 also can include fluid feed slots (not shown in FIG. 7A) through which ink can be provided to printhead die 251.

In this embodiment, inclined surfaces 270 can also be formed during the insert molding process by including corresponding features in the injection molding tool. In such a case, there is no additional cost for providing the inclined surfaces 270. It is simply a matter of providing corresponding features in the molding tool to form the inclined surfaces 270. In another embodiment the inclined surfaces 270 can be provided as part of mounting substrate 252 (e.g. as a part of a ceramic substrate or of a plastic injection molded substrate). In yet another embodiment the inclined surfaces 270 can be formed during the subsequent printhead assembly process, for example, during the forming of the encapsulant 256 (shown in FIG. 2).

For embodiments in which the inclined surfaces 270 are formed using a different material (or formed at a different time) than mounting substrate 252, but in a region that overlies mounting substrate 252, it can be advantageous to provide a groove 286 in the surface of mounting substrate 252 to help anchor the inclined surface 270 in place. Groove 286 can also provide an improved flow path for injection molding so that the molten plastic can more reliably flow to form the inclined surfaces 270.

Figure 7B:
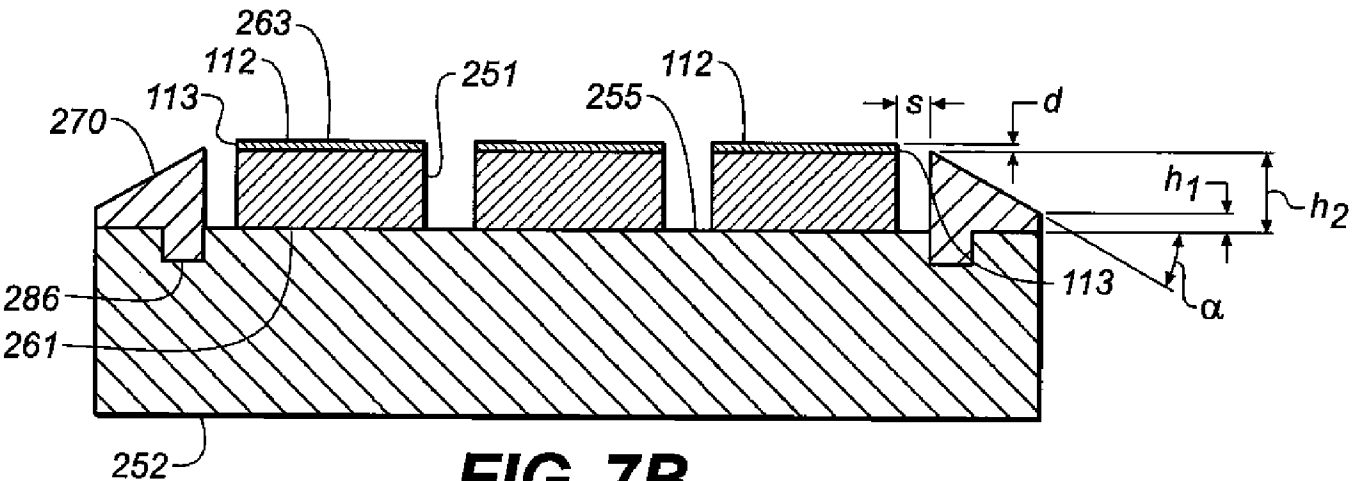

FIG. 7B shows a magnified view (not to scale) of a portion of FIG. 7A near the inclined surfaces 270 and the printhead die 251. Printhead die 251 has a first face 261 that is bonded to the mounting surface 255 of mounting substrate 252. Opposite to first face 261 of printhead die 251 is second face 263 that includes an array of nozzles or other type of marking element in nozzle plate 112. Inclined surface 270 is positioned near die edge 113 (a distance s away from edge 113 at its closest point) and does not overlap edge 113 of die 251. At a first location of inclined surface 270 (for example, the portion of inclined surface 270 that is closest to die edge 113), the distance from the inclined surface 270 to the mounting surface 255 is $h_2$. At a second location of the inclined surface that is farther away from die edge 113 than the first location is, the distance from the inclined surface 270 to the mounting surface 255 is $h_1$, and $h_2$ is greater than $h_1$. This is true for both inclined surfaces 270 shown in FIG. 7B, although for clarity only one of them is labeled with the various distances.

FIGS. 7A and 7B are shown after printhead assembly steps in which printhead die 251 are bonded to mounting substrate 252. There can be some positioning error in the printhead die 251 due to manufacturing tolerances. However, neglecting this positioning error, which is typically small, the inclined surface 270 is positioned at a predetermined distance s from the edge 113 of the printhead die 251. It is contemplated that s can equal zero if the printhead die 251 abuts the edge of inclined surface 270.

In the example shown in FIG. 7B, the "upper" portion of the inclined surface 270 (i.e. the portion of inclined surface 270 that is closest to die edge 113) is a distance d below the top of the second face 263 of the printhead die (i.e. a distance d below the top of nozzle plate 112). However, in other embodiments the upper portion of the inclined surface 270 can be above the second face 263 of printhead die 251. It has been found that the inclined surface 270 is most effective in protecting the printhead die 251 if the height of the upper portion (relative to the mounting surface 255) is within 0.2 mm of height of the second face 263 (relative to the mounting surface 255). If the height of the upper portion of inclined surface 270 extends more than about 0.2 mm beyond the nozzle plate 112, it can increase the incidence of ink smearing through inadvertent contact of the upper surface and the printed paper. If the height of the nozzle face 112 extends more than about 0.2 mm beyond the upper portion of inclined surface 270, there can be insufficient protection of the nozzle face 112 against paper strikes.

Inclined surface 270 is inclined at an angle $\alpha$ relative to the mounting surface 255, as illustrated in FIG. 7B. It has been found that the inclined surface 270 provides most effective protection against damage of nozzle face 112 if $\alpha$ is less than 40°.

Figure 8:
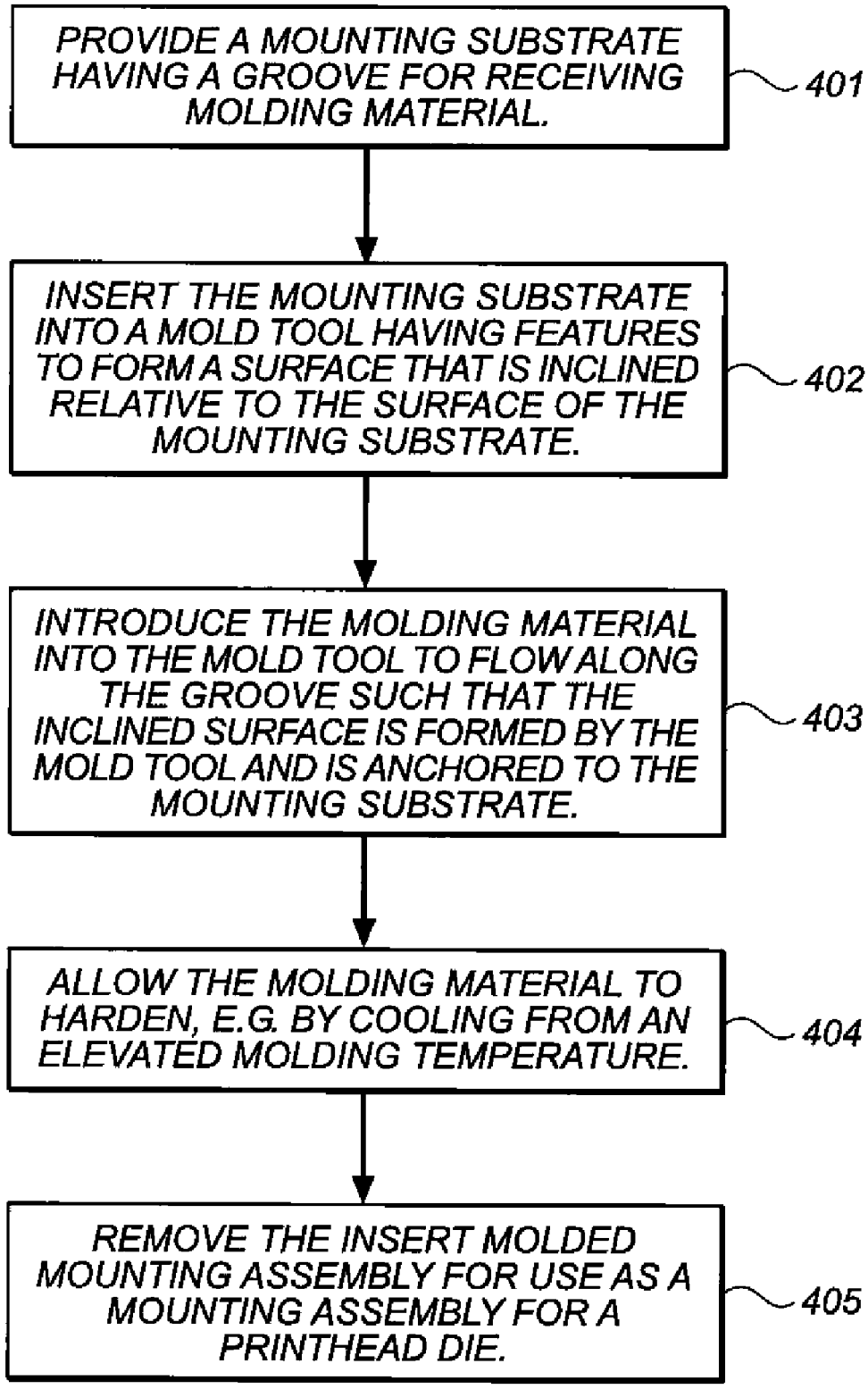
FIG. 8 is a flow chart listing fabrication steps for a mounting assembly according to an embodiment of the present invention.

A method of fabrication of a mounting assembly 280 is shown in the flow chart of FIG. 8 for a printhead die 251, where the mounting assembly 280 includes one or more inclined surfaces 270. In step 401*a* mounting substrate 252 is provided. Mounting substrate 252 can be made of ceramic, and has a groove 286 in its surface 255 for receiving molding material. In step 402, mounting substrate 252 is inserted into a mold tool. The mold tool has features that will guide molding material to form a surface that is inclined relative to the surface of the mounting substrate 252. In step 403, molding material is introduced into the mold tool. For the case of injection molding, the molding material can be Noryl GFN3 (30% glass filled), for example, which is introduced into the mold tool in a molten state at elevated temperature. The molten molding material flows along the groove 286, flows around mounting substrate 252, and flows into the features for forming the inclined surface 270. In step 404, the molding material is allowed to harden. In the example of injection molding, this occurs as the molding material is cooled. In other types of molding, the molding material can harden, for example, by allowing it to cure. At step 405 the insert molded mounting assembly 280 is removed from the molding tool and is stored for subsequent printhead assembly steps (not shown) in which printhead die 251 are bonded to mounting substrate 252.

Figure 9:
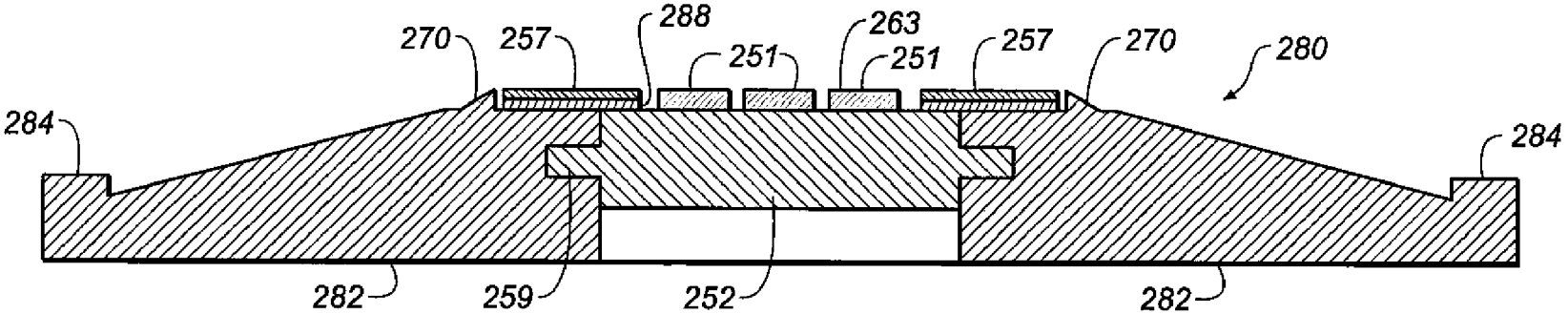
FIG. 9 is a schematic cross-sectional view of a portion of a mounting assembly according to an embodiment of the present invention.

In the embodiment described above, the inclined surface or surfaces 270 are positioned between the flex circuit 257 and the printhead die 251. FIG. 9 schematically shows a cross section of a second alternative embodiment of a mounting assembly 280 in which the flex circuit 257 is positioned between the inclined surface(s) 270 and the printhead die 251. In this second embodiment the inclined surface 270 is not in direct contact with the mounting substrate 252, so no groove is needed to anchor it to the mounting substrate 252. As in the first embodiment, mounting assembly 280 of the second embodiment can be formed by insert molding and the inclined surfaces 270 can be formed as part of the molding process by corresponding features in the mold tool. Optionally in the second embodiment a shim 288 is positioned underneath the flex circuit 257 to position the top of the flex circuit 257 at a similar height as the second face 263 of printhead die 251. Because the flex circuit 257 surrounds the printhead die 251 in this example (similar to FIGS. 3 and 6), the printhead die 251 are effectively positioned in a recess for further protection. The inclined surfaces 270 extend substantially parallel to array direction 254, as in FIG. 6, but they are positioned outside the flex circuit 257. In this embodiment, the flex circuit 257 and/or the shim 288 can be considered to be a spacer between the inclined surface 270 and edge 113.

Figure 10:
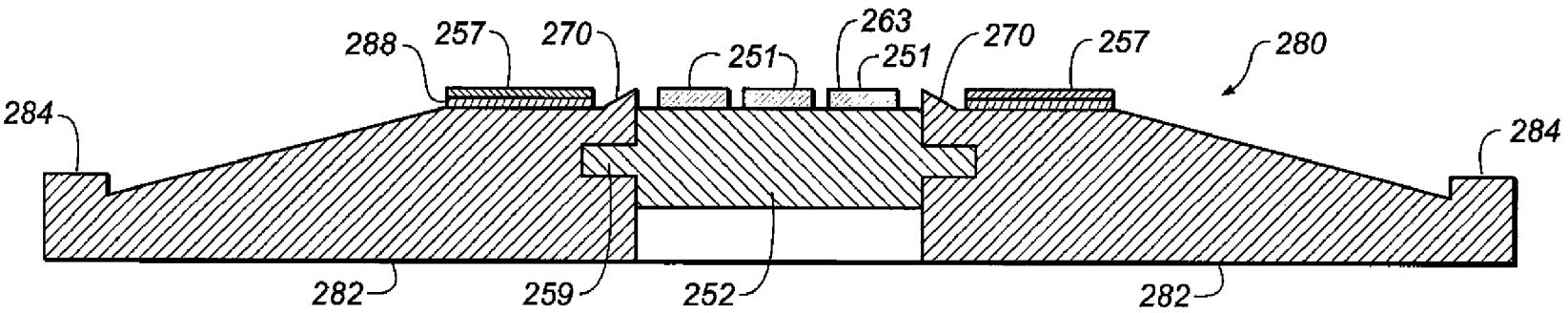
FIG. 10 is a schematic cross-sectional view of a portion of a mounting assembly according to an embodiment of the present invention.

FIG. 10 schematically shows a cross-section of a third alternative embodiment of a mounting assembly 280 having inclined surfaces 270. In this third embodiment, the inclined surfaces 270 are adjacent the edge of the ceramic mounting substrate 252 at mounting surface 255, although the inclined surfaces 270 overlie the outer rim 259 of mounting substrate 252 that is used to secure the mounting substrate 252 to the plastic portion of mounting assembly 280. The inclined surfaces 270 in this embodiment are between the flex circuit 257 and the printhead die 251 but there is no groove similar to groove 286 that was present in the first embodiment.

The invention has been described in detail with particular reference to certain preferred embodiments thereof, but it will be understood that variations and modifications can be effected within the spirit and scope of the invention. In particular, the invention has been described in detail for inkjet printheads. More generally the invention can also be advantageous for other types of printheads which are moved relative to a recording medium. Such printheads include marking elements (analogous to the nozzles and drop forming mechanisms described above) for marking on the recording medium.

PARTS LIST

10 Inkjet printer system
12 Image data source
14 Controller
16 Electrical pulse source
18 First fluid source
19 Second fluid source
20 Recording medium
100 Ink jet printhead
110 Inkjet printhead die
111 Die substrate
112 Nozzle face
113 Edge of nozzle plate
120 First nozzle array
121 Nozzle in first nozzle array
122 Ink delivery pathway for first nozzle array
130 Second nozzle array
131 Nozzle in second nozzle array
132 Ink delivery pathway for second nozzle array
181 Droplet ejected from first nozzle array
182 Droplet ejected from second nozzle array
200 Carriage
250 Printhead chassis
251 Printhead die
252 Mounting substrate
253 Nozzle array
254 Nozzle array direction
255 Mounting surface of mounting substrate
256 Encapsulant
257 Flex circuit
258 Connector board
259 Outer rim of mounting substrate
261 Die bonding face of printhead die
262 Multichamber ink supply
263 Nozzle plate face of printhead die
264 Single chamber ink supply
270 Inclined surface
280 Mounting assembly
282 Extended portion of mounting assembly
284 Alignment features
286 Groove in mounting substrate to anchor inclined surface
288 Shim below flex circuit
300 Printer chassis
302 Paper load entry
303 Print region
304 Paper exit
306 Right side of printer chassis
307 Left side of printer chassis
308 Front portion of printer chassis
309 Rear portion of printer chassis
310 Hole for paper advance motor drive gear
311 Feed roller gear
312 Feed roller
313 Forward rotation of feed roller
320 Pickup roller
322 Turn roller
323 Idler roller
324 Discharge roller
325 Star wheel
330 Maintenance station
370 Stack of media
371 Top sheet
372 Folded edge of paper
380 Carriage motor
382 Carriage rail
384 Belt
390 Printer electronics board
392 Cable connectors

What is claimed:

1. A printhead comprising:

a substrate including a mounting surface;

a printhead die including:

a first face that is bonded to the mounting surface of the substrate;

a second face opposite the first face, the second face including at least one array of marking elements disposed along a marking element array direction;

at least one edge of the printhead die is substantially parallel to the marking element array direction; and an inclined surface that is positioned proximate to, but not overlapping the edge of the printhead die, wherein a distance from the inclined surface to the mounting surface of the substrate at a first location is greater than a distance from the inclined surface to the mounting surface of the substrate at a second location, the first location also being nearer the at least one edge of the printhead die that is substantially parallel to the marking element array direction than the second location.

2. The printhead claimed in claim 1, wherein the inclined surface is positioned a predetermined distance from the edge of the printhead die.

3. The printhead claimed in claim 2, further comprising a spacer between the inclined surface and the edge of the printhead die.

4. The printhead claimed in claim 1, wherein the inclined surface has an upper portion that is within 0.2 mm of a vertical distance for the second face of the printhead die.

5. The printhead claimed in claim 1, wherein the substrate is formed of a first material and the inclined surface is formed of a second material.

6. The printhead claimed in claim 5, wherein the second material is plastic.

7. The printhead claimed in claim 6, wherein the second material is injection molded.

8. The printhead claimed in claim 7, wherein the substrate includes a groove for injection molding of the second material.

9. The printhead claimed in claim 1, wherein the substrate and the inclined surface are formed of a same material.

10. The printhead claimed in claim 1, wherein both the substrate and the inclined surface are injection molded.

11. The printhead claimed in claim 1, wherein the inclined surface is anchored to the substrate.

12. The printhead claimed in claim 1, wherein an angle of the inclined surface with respect to the mounting surface is less than 40 degrees.

13. A method for forming a mounting assembly for a printhead die; comprising the steps of:

a) providing a mounting substrate, wherein the mounting substrate includes at least one groove for receiving molding material;

b) inserting the mounting substrate into a mold tool having features to form an inclined surface;

c) introducing molding material into the mold tool to flow along the groove and into the features such that the inclined surface is formed by the mold tool and is anchored to the mounting substrate; and d) removing the mounting assembly from the mold tool for subsequently mounting a printhead die.

14. An inkjet printing apparatus comprising:

a carriage that travels in a carriage scanning direction; and a printhead positioned on the carriage, comprising:

a substrate including a mounting surface;

a printhead die including:

a first face that is bonded to the mounting surface of the substrate;

a second face opposite the first face, the second face including at least one array of marking elements disposed along a marking element array direction;

an edge that is substantially parallel to the marking element array direction; and an inclined surface that is positioned proximate to, but not overlapping the edge of the printhead die, wherein a distance from the inclined surface to the mounting surface of the substrate at a first location is greater than a distance from the inclined surface to the mounting surface of the substrate at a second location, the first location also being nearer the edge of the printhead die that is substantially parallel to the marking element array direction than the second location.

* * * * *